US009611555B2

(12) United States Patent
Bhavaraju

(10) Patent No.: US 9,611,555 B2
(45) **Date of Patent: *Apr. 4, 2017**

(54) CHEMICAL SYSTEMS AND METHODS FOR OPERATING AN ELECTROCHEMICAL CELL WITH AN ACIDIC ANOLYTE

(75) Inventor: Sai Bhavaraju, West Jordan, UT (US)

(73) Assignee: CERAMATEC, INC., Salt Lake City, UT (US)

( * ) Notice: Subject to any disclaimer, the term of this patent is extended or adjusted under 35 U.S.C. 154(b) by 147 days.

This patent is subject to a terminal disclaimer.

(21) Appl. No.: 13/253,771

(22) Filed: Oct. 5, 2011

(65) Prior Publication Data

US 2012/0085657 A1 Apr. 12, 2012

Related U.S. Application Data

(60) Provisional application No. 61/390,961, filed on Oct. 7, 2010.

(51) Int. Cl.
*C25B 9/08* (2006.01)
*C25B 1/26* (2006.01)
(Continued)

(52) U.S. Cl.
CPC ..... *C25B 9/08* (2013.01); *C25B 1/26* (2013.01); *C25B 1/46* (2013.01); *C25B 13/04* (2013.01); *C25B 15/08* (2013.01)

(58) Field of Classification Search
CPC .... C25C 1/10; C25B 1/22; C25B 1/26; C25B 1/34; C25B 1/46; C25B 1/24; C25B 1/245;
(Continued)

(56) References Cited

U.S. PATENT DOCUMENTS 2,715,608 A 8/1955 Casciani et al.
3,222,267 A * 12/1965 Tirrell et al. ..... 205/496
(Continued)

OTHER PUBLICATIONS

Lee, Jong K., "Written Opinion of the International Searching Authority", PCT/US2012/020822 (corresponding the U.S. App. No. 13/347,530, (Aug. 30, 2012), 1-3.
(Continued)

*Primary Examiner* — Ciel Thomas
(74) *Attorney, Agent, or Firm* — Paul S. Cha

(57) ABSTRACT

An electrochemical cell having a cation-conductive ceramic membrane and an acidic anolyte. Generally, the cell includes an anolyte compartment and a catholyte compartment that are separated by a cation-conductive membrane. A diffusion barrier is disposed in the anolyte compartment between the membrane and an anode. In some cases, a catholyte is channeled into a space between the barrier and the membrane. In other cases, a chemical that maintains an acceptably high pH adjacent the membrane is channeled between the barrier and the membrane. In still other cases, some of the catholyte is channeled between the barrier and the membrane while another portion of the catholyte is channeled between the barrier and the anode. In each case, the barrier and the chemicals channeled between the barrier and the membrane help maintain the pH of the liquid contacting the anolyte side of the membrane at an acceptably high level.

17 Claims, 5 Drawing Sheets

(51) Int. Cl.
*C25B 1/46* (2006.01)
*C25B 13/04* (2006.01)
*C25B 15/08* (2006.01)

(58) Field of Classification Search
CPC C25B 1/265; C25B 9/08; C25B 13/04; C25B 15/08
USPC ..... 204/237, 252, 263; 205/349, 556, 205/637–639; 210/748.2
See application file for complete search history.

(56) References Cited

U.S. PATENT DOCUMENTS 3,523,755 A * 8/1970 McRae ..... 423/539
3,984,295 A 10/1976 Kametani et al.
4,066,519 A 1/1978 Kadija et al.
4,110,191 A 8/1978 Specht et al.
4,213,833 A 7/1980 Lefevre
4,234,393 A * 11/1980 Hepworth ..... C25C 1/22 205/49
4,256,552 A 3/1981 Sweeney
4,308,117 A 12/1981 Sweeney
4,334,968 A 6/1982 Sweeney
4,340,452 A 7/1982 DeNora
4,448,662 A 5/1984 Dubois et al.
4,548,730 A 10/1985 Koslow
5,290,405 A 3/1994 Joshi et al.
5,366,605 A 11/1994 Wang
5,389,211 A * 2/1995 Sharifian ..... B01D 61/44 205/455
5,427,658 A 6/1995 Allen
5,580,430 A 12/1996 Balagopal et al.
5,709,789 A 1/1998 Shay et al.
6,770,187 B1 8/2004 Putter et al.
7,179,363 B2 * 2/2007 DiMascio et al. ..... 205/556
2003/0024879 A1 2/2003 Carson et al.
2003/0082095 A1 * 5/2003 DiMascio ..... 423/477
2004/0124094 A1 7/2004 Bo et al.
2005/0177008 A1 * 8/2005 Balagopal et al. ..... 568/851
2007/0138020 A1 * 6/2007 Balagopal et al. ..... 205/500
2008/0173551 A1 * 7/2008 Joshi et al. ..... 205/450
2008/0245671 A1 10/2008 Balagopal et al.
2008/0290044 A1 11/2008 Nanjundiah et al.
2009/0057162 A1 * 3/2009 Balagopal et al. ..... 205/450
2009/0107850 A1 4/2009 Fang et al.
2009/0314652 A1 12/2009 Buschmann et al.
2010/0044241 A1 * 2/2010 Pendleton et al. ..... 205/500
2010/0044242 A1 * 2/2010 Bhavaraju et al. ..... 205/556
2010/0116649 A1 5/2010 Maekawa et al.
2011/0089045 A1 * 4/2011 Cardarelli ..... 205/349
2012/0085658 A1 * 4/2012 Bhavaraju et al. ..... 205/443

OTHER PUBLICATIONS

Lee, Jong K., "International Search Report", PCT/US2012/020822 corresponding the U.S. Appl. No. 13/347,530, (Aug. 30, 2012),1-3.
Jo, Soo I., "International Search Report", PCT App. No. 2011/054968 (Corresponding the U.S. Appl. No. 13/253,771, (May 31, 2012),1-3.
Jo, Soo I., "Written Opinion of the International Searching Authority", PCT App. No. 2011/054968 (Corresponding the U.S. Appl. No. 13/253,771, (May 31, 2012),1-5.
Jo, Soo I., "International Search Report", PCT App. No. 2011/055458 (Corresponding to U.S. Appl. No. 13/269,412, (May 31, 2012),1-3.
Jo, Soo I., "Written Opinion of the International Searching Authority", PCT App. No. 2011/055458 (Corresponding to U.S. Appl. No. 13/269,412, (May 31, 2012),1-5.
Wilkins III, Harry D., "Non-Final Office Action", U.S. Appl. No. 13/269,412, (Sep. 18, 2014),1-12.
Wilkins III, Harry D., "Notice of Allowance", U.S. Appl. No. 13/269,412, (Jan. 5, 2015),1-5.
Friday, Steven A. , "Final Office Action", U.S. Appl. No. 13/347,530, Jan. 29, 2016, 1-30.
Friday, Steven A., "Non-Final Office Action", U.S. Appl. No. 13/347,530, (Aug. 26, 2015),1-21
Rakib, et al., "Behaviour of Nafion 350 membrane in sodium sulfate electrochemical splitting:continuous process modelling and pilot scale tests", *Journal of Applied Electrochemistry 29*, (May 25, 1999),1439-1448.

* cited by examiner

CHEMICAL SYSTEMS AND METHODS FOR OPERATING AN ELECTROCHEMICAL CELL WITH AN ACIDIC ANOLYTE

CROSS-REFERENCE TO RELATED APPLICATIONS

This application claims the benefit of U.S. Provisional Application No. 61/390,961, filed Oct. 7, 2010, entitled "Chemical Systems and Methods For Operating an Electrochemical Cell With an Acidic Anolyte" the entire disclosure of which is hereby incorporated by reference.

FIELD OF THE INVENTION

The present invention relates in general to electrochemical cells comprising a cation-conductive membrane. More particularly, the present invention discusses systems and methods for operating an electrochemical cell comprising a diffusion barrier, an acidic anolyte, and an alkali cation-conductive ceramic membrane, such as a NaSICON membrane, which is normally not compatible with acidic conditions. Generally, the described systems and methods act to protect the membrane from the acidic anolyte.

BACKGROUND OF THE INVENTION

Electrolytic cells comprising ceramic membranes that selectively transport ions are known in the art. By having an ion-selective membrane in the electrolytic cell, certain ions are allowed to pass between the cell's anolyte compartment and catholyte compartment while other chemicals are maintained in their original compartments. Thus, through the use of an ion-specific membrane, an electrolytic cell can be engineered to be more efficient and to produce different chemical reactions than would otherwise occur without the membrane.

These ion-selective membranes can be selective to either anions or cations. Moreover, some cation-selective membranes are capable of selectively transporting alkali cations. By way of example, NaSICON (Na Super Ion CONducting) membranes selectively transport sodium cations, while LiSICON (Li Super Ion CONducting) and KSICON (K Super Ion CONducting) membranes selectively transport lithium and potassium cations, respectively.

Electrolytic cells comprising alkali cation-selective membranes are used to produce a variety of different chemicals and to perform various chemical processes. In some cases, such electrolytic cells convert alkali salts into their corresponding acids. In other cases, such electrolytic cells may also be used to separate alkali metals from mixed alkali salts. One non-limiting example of a conventional 2 compartment electrolytic cell 10 is illustrated in FIG. 1. Specifically, FIG. 1 illustrates the cell 10 comprises an anolyte compartment 12 and a catholyte compartment 14 that are separated by a NaSICON membrane 16.

During operation, the anolyte compartment 12 comprises an aqueous sodium-salt solution (NaX, wherein X comprises an anion capable of combining with a sodium cation to form a salt) and current is passed between an anode 18 and a cathode 20. Additionally, FIG. 1 shows that as the cell 10 operates, water ($H_2O$) is split at the anode 18 to form oxygen gas ($O_2$) and protons ($H^+$) through the reaction $2H_2O \rightarrow O_2 + 4H^+ + 4e^-$. FIG. 1 further shows that the sodium salt NaX in the anolyte is split (according to the reaction $4NaX + 4H^+ \rightarrow 4HX + 4Na^+$) to (a) allow sodium cations ($Na^+$) to be transported through the NaSICON membrane 16 into the catholyte compartment 14 and (b) to allow anions ($X^-$) to combine with protons to form an acid (HX) that corresponds to the original sodium salt.

The above-mentioned electrolytic cell may be modified for use with other alkali metals and acids corresponding to the alkali salts used in the anolyte. Moreover, it will be appreciated that other electrolytic reactions may occur which result in proton formation and corresponding lowering of pH within the anolyte compartment. Low pH anolyte solutions in such electrolytic cells have shortcomings. In one example, at lower pH, such as a pH less than about 5, certain alkali conducting ceramic membranes, such as NaSICON-type membranes, become less efficient or unable to transport sodium cations. Accordingly, as the electrolytic cell operates and acid is produced in the anolyte compartment, the cell becomes less efficient or even inoperable. In another example, acid produced in the anolyte compartment can actually damage the NaSICON membrane and thereby shorten its useful lifespan.

BRIEF SUMMARY OF THE INVENTION

The present invention provides systems and methods for operating an 2-compartment electrochemical cell having a cation-conductive ceramic membrane with an acidic anolyte solution. The present invention also provides systems and methods for operating a multi-compartment electrochemical cell having a cation-conductive ceramic membrane adjacent to an acidic solution. Generally, the described systems and methods act to protect the ceramic membrane and keep it functioning in acidic conditions during electrolysis.

In some implementations, the described electrochemical cell comprises a catholyte compartment and an anolyte compartment that are separated by a cation-conductive ceramic membrane, such as a NaSICON membrane. In the cell, the catholyte compartment comprises a cathode that is positioned to contact a catholyte solution. Similarly, the anolyte compartment comprises an anode that is positioned to contact an anolyte solution. Furthermore, the cell comprises a power source that is capable of passing current between the anode and the cathode. When the power source is used to pass current between the anode and the cathode and an aqueous solution is present in both the anolyte and the catholyte compartments, protons are generally generated at the anode and hydroxide ions are generally formed at the cathode. Thus, as the cell functions, the pH of the anolyte solution may decrease while the pH of the catholyte solution may increase.

In addition to the aforementioned components, the electrochemical cell preferably comprises a diffusion barrier that is disposed in the anolyte compartment between the anode and the cation-conductive membrane. Accordingly, the diffusion barrier partitions the anolyte compartment into at least two spaces, namely a first anolyte space disposed between the membrane and the barrier and a second anolyte space that houses the anode.

The diffusion barrier can comprise any characteristic that allows it to both slow the rate at which chemicals pass between the first space to the second space and mix with each other. It should allow at least some ions to pass therethrough. In one representative example, the diffusion barrier comprises a membrane or a separator that has at least one or more holes or perforations, which allow fluids to pass between the first space and the second space. In one other example, the diffusion barrier comprises a membrane or separator that is porous or permeable to at least cations which later pass through the ceramic cation-conductive membrane. In other example, the diffusion barrier comprises a cation-exchange membrane that transports cations which later pass through the ceramic cation-conductive membrane.

In some implementations, the cell further comprises one or more fluid inlets that open into the first space and/or the second space. While such inlets may perform any suitable function, in some cases, such inlets allow a fluid having a higher pH than the fluid in the second space to be introduced into the first space to thereby protect the anode side of the cation-conductive membrane from being exposed to the low pH of the anolyte solution in the second space.

In a first non-limiting example of how a fluid inlet in the cell can function, a fluid inlet opening into the first space allows a portion of the catholyte solution from the catholyte compartment to flow into the first space to raise the pH of the fluid contacting the anolyte side of the cation-conductive membrane.

In this example, the fluid in the first space and the fluid in the second space may flow at any suitable flow rate with respect to each other. In some instances, however, the fluid in the first space flows at a slower flow rate than the fluid in the second space such that it has a longer retention time within the first space compared to the retention time of fluid in the second space. As a result, the fluid in the second space is not given much time to react with and/or to be neutralized by the higher pH fluid in the first space.

In a second non-limiting example, a fluid inlet opening into the first space allows a chemical with a basic pH to be introduced into the first space to protect the anolyte side of the cation-conductive membrane from being damaged by the acidic pH of the fluid in the second space. Some examples of suitable chemicals with a basic pH that can be channeled into the first space include, but are not limited to, ammonium hydroxide and ammonia gas.

In this second example, the fluid in the first space and the fluid in the second space can flow at any suitable speed with respect to each other. However, as in the last example, the fluid in the second space preferably flows at a faster flow rate than does the fluid in the first space.

In a third non-limiting example, fluid inlets opening into both the first space and the second space can allow a catholyte outlet stream from the catholyte compartment to be split into a first portion that flows into the first space and a second portion that flows into the second space. In this manner, the cell can allow one portion of the basic catholyte to protect the cation-conductive membrane while allowing a second portion of the catholyte to react at the anode in the second space to electrochemically produce desired chemical products.

While the fluids in the first and the second spaces of the cell in this third example can flow through the spaces at any suitable flow rate with respect to each other, in some instances, the fluid in the first space flows at a faster flow rate than does the fluid in the second space, such that the retention time of fluid within the first space is lower than the retention time of fluid within the second space. As a result, the fluid in the first space has little opportunity to be neutralized by the acidic fluid in the second space. Accordingly, the fluid in the first space protects the anolyte side of the cation-conductive membrane from being damaged by the more acidic fluid in the second space. Additionally, because the fluid in the second space is retained in the second space longer than the fluid in the first space, chemicals in the fluid of the second space are allowed more time to react at the anode and form desired chemical products.

In this third example, an outlet stream from the first space and an outlet stream from the second space are optionally mixed together. In such cases, the relative amount of fluid passing through the first space is less than the relative amount of fluid passing through the second space. In this manner, the cell can be used to produce a relatively higher concentration of chemical products in the anolyte compartment than would be possible without the diffusion barrier.

While the described systems and methods have proven particularly useful for separating sodium from mixed alkali salts, for producing acids that correspond to sodium salts (e.g. sulfuric acid from sodium sulfate, acetic acid from sodium acetate), for obtaining sodium hydroxide, and for obtaining chlorine-based oxidants, such as sodium hypochlorite, the skilled artisan will recognize that the described systems and methods can be modified to be used in a variety of electrochemical processes where it is desirable to operate the anode at a pH lower than the typical safe working pH of NaSICON-type conductive membranes. It will further be appreciated that the apparatus and methods within the scope of the present invention may be used in relation to other alkali metals besides sodium. For example, instead of using an electrochemical cell that includes a NaSICON membrane and an anolyte solution with a sodium salt (NaX), the described systems and methods may be use with any other suitable alkali salt (e.g., LiX, KX, etc.) and with any other suitable alkali-cation-conductive membrane (e.g., a LiSICON membrane, a KSICON membrane, etc.) that is capable of transporting cations (e.g., $Li^+$, $K^+$, etc.) from the anolyte compartment to the catholyte compartment.

These features and advantages of the present invention will become more fully apparent from the following description and appended claims, or may be learned by the practice of the invention as set forth hereinafter.

BRIEF DESCRIPTION OF THE SEVERAL DRAWINGS

In order that the manner in which the above-recited and other features and advantages of the invention are obtained and will be readily understood, a more particular description of the invention briefly described above will be rendered by reference to specific embodiments thereof that are illustrated in the appended drawings. Understanding that the drawings depict only typical embodiments of the invention and are not therefore to be considered to be limiting of its scope, the invention will be described and explained with additional specificity and detail through the use of the accompanying drawings in which:

Figure 1:
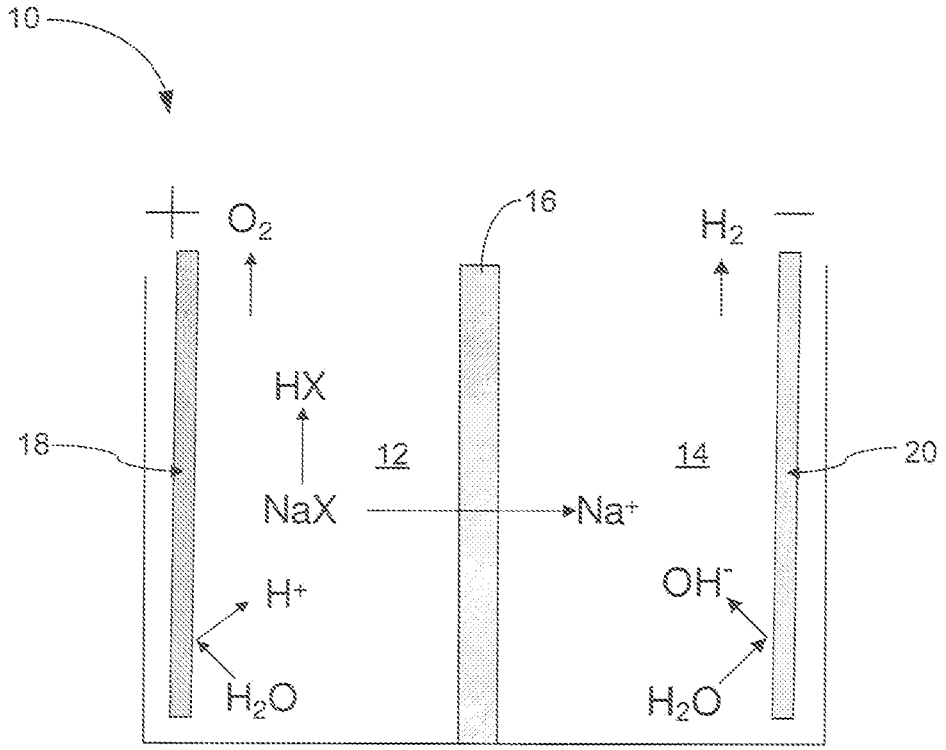
Fig. 1 (Prior Art)
FIG. 1 depicts a schematic diagram of an embodiment of a prior art electrolytic cell comprising a cation-conductive membrane.
Figure 2:
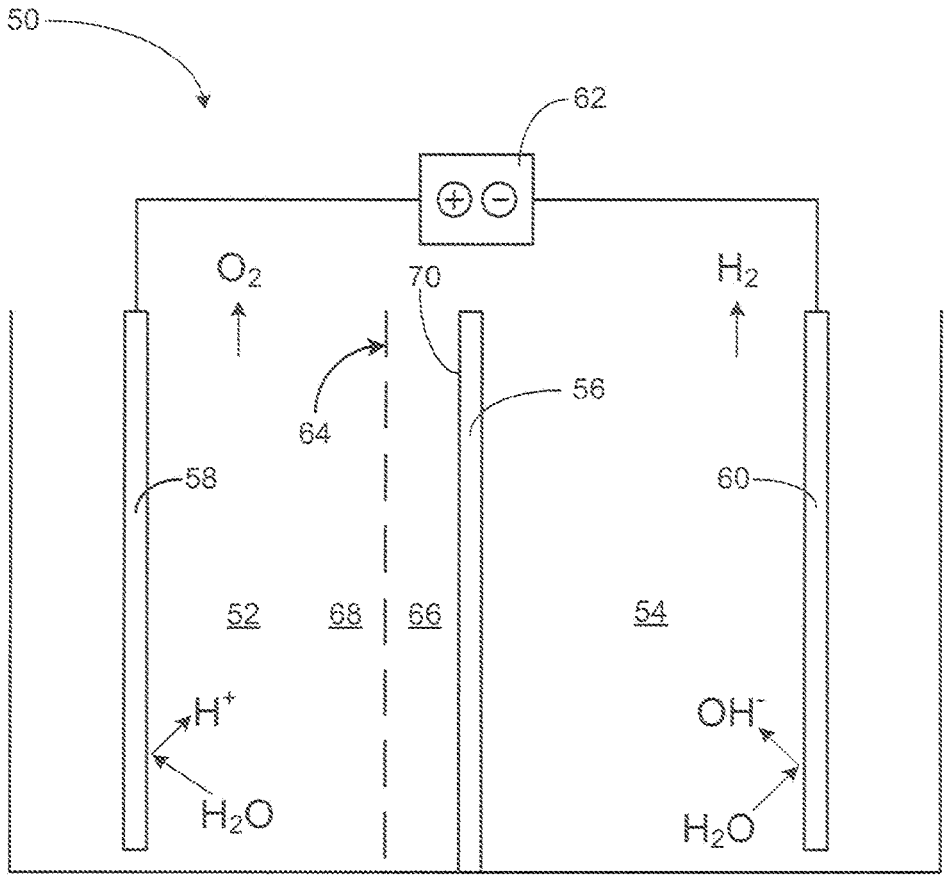
FIG. 2 depicts a schematic diagram of a representative embodiment of an electrochemical cell comprising a diffusion barrier and a cation-conductive membrane.
Figure 4:
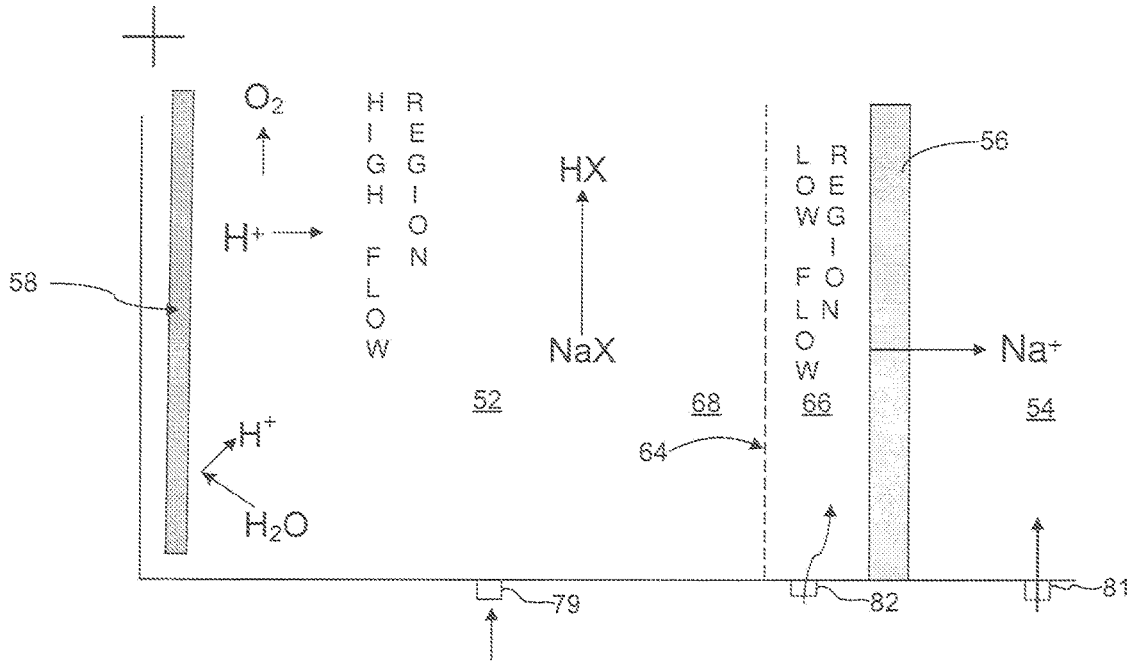
Figure 5:
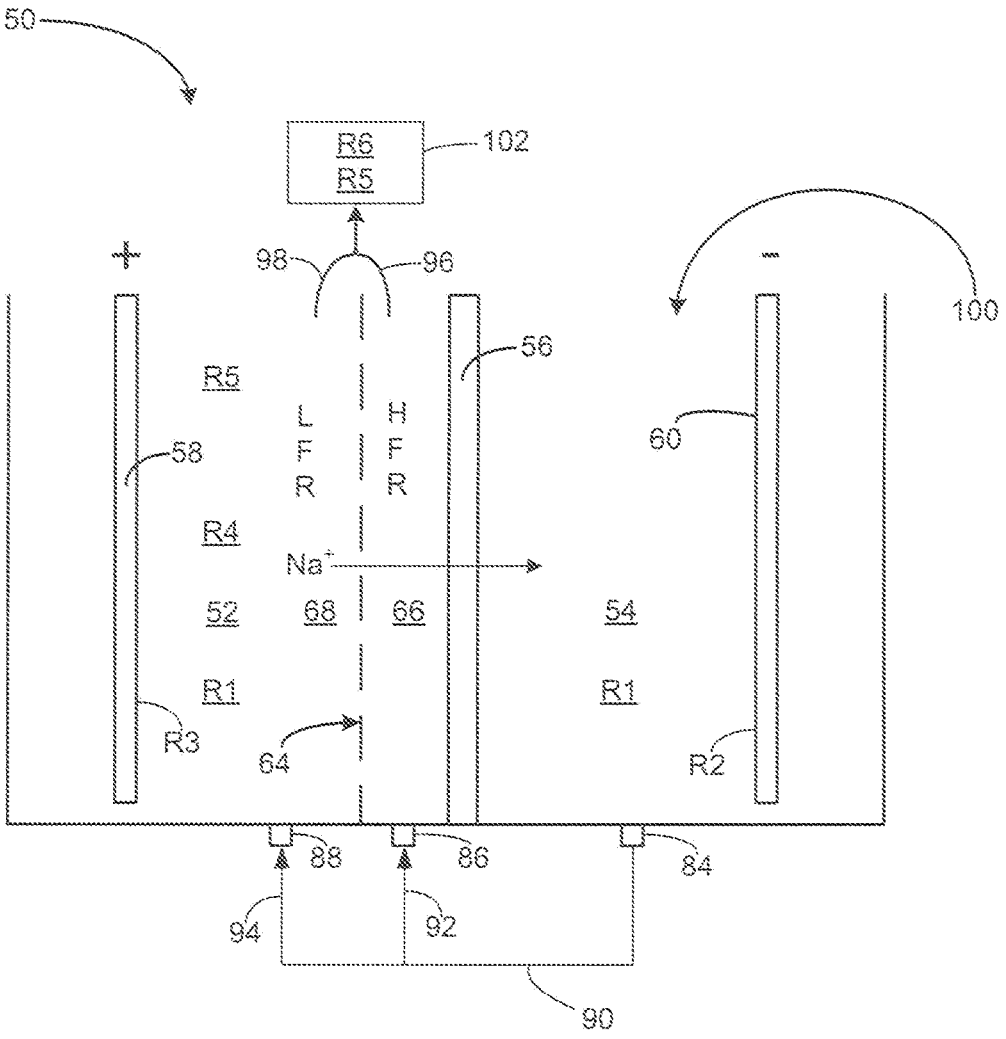

FIG. 4 depicts a schematic diagram of a representative embodiment of the electrochemical cell of FIG. 2, wherein the cell comprises an inlet that allows an acid neutralizing chemical to flow into the space between the barrier and the membrane; and FIG. 5 depicts a schematic diagram of a representative embodiment of the electrochemical cell of FIG. 2, wherein the cell comprises an inlet that allows catholyte to flow into the space between the barrier and the membrane and to flow into a second space between the diffusion barrier and an anode.

DETAILED DESCRIPTION OF THE INVENTION

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics of the invention may be combined in any suitable manner in one or more embodiments. In the following description, numerous specific details are provided, such as examples of suitable cation-conductive membranes, anolytes, catholytes, etc., to provide a thorough understanding of embodiments of the invention. One having ordinary skill in the relevant art will recognize, however, that the invention may be practiced without one or more of the specific details, or with other methods, components, materials, and so forth. In other instances, well-known structures, materials, or operations are not shown or described in detail to avoid obscuring aspects of the invention.

The present invention relates to systems and methods for operating an electrochemical cell comprising a cation-conductive membrane and an acidic anolyte solution. Generally, the described systems and methods act to protect the membrane and keep it functioning as acid is produced in the anolyte solution. Accordingly, while the described systems and methods protect the cation-conductive membrane, they also allow the cell to produce acids corresponding to alkali salts, to produce pure alkali metals, to produce alkali bases, to produce chlorine-based oxidant products, and/or to produce a variety of other chemical products. To provide a better understanding of the described systems and methods, the electrochemical cell is first described, followed by a description of a variety of methods for using the cell.

The electrochemical cell can comprise any suitable characteristic that allows it to produce one or more of the aforementioned chemical products. By way of illustration, FIG. 2 illustrates a representative embodiment in which the electrochemical cell 50 comprises an anolyte compartment 52 and a catholyte compartment 54 that are separated by a cation-conductive ceramic membrane 56. FIG. 2 further shows that while the anolyte compartment 52 houses an anode electrode 58 positioned to contact an anolyte (not shown), the catholyte compartment 54 comprises a cathode electrode 60 positioned to contact a catholyte (not shown). FIG. 2 also shows that the cell 50 comprises a power source 62 that is capable of passing current between the anode 58 and the cathode 60. Moreover, FIG. 2 shows that a diffusion barrier 64 is disposed in the anolyte compartment 52 in a manner that separates that compartment 52 into a first anolyte space 66, which is located between the barrier 64 and the membrane 56, and a second anolyte space 68, which houses the anode 58.

The anode electrode 58 can comprise one or more of a variety of materials that allow it to evolve protons ($H^+$) or initiate another desired electrolytic reaction at the anode 58 when it is contacted with an aqueous anolyte and when current is running between the electrodes. Some non-limiting examples of suitable anode materials comprise dimensionally stabilized anode-platinum on titanium (DSA), platinized titanium, ruthenium (IV) dioxide ($RuO_2$), and other suitable anode materials that are well known in the art.

The cathode electrode 60 can comprise one or more of a variety of suitable materials that allow it to initiate a desired electrolytic reaction at the cathode 60. In one non-limiting example, the cathode 60 evolves hydroxide ions ($OH^-$) when it is in contact with an aqueous catholyte and when current is running between the electrodes. Some non-limiting examples of suitable cathode materials include nickel, stainless steel, graphite, nickel-cobalt-ferrous alloys (e.g., a KOVAR® alloy), and other conventional materials that are stable in a caustic pH.

FIG. 2 shows that the power supply 62 can be connected to the anode 58 and the cathode 60 to apply a voltage and current between the two electrodes to drive reactions within the electrochemical cell 50. Indeed, according to some embodiments, as the power supply causes current to pass between the anode 58 and cathode 60, FIG. 2 shows that where the anolyte 52 and catholyte 54 compartments contain an aqueous solution, protons ($H^+$) are evolved at the anode and hydroxide ions ($OH^-$) are evolved at the cathode 60. This power supply can be any known or novel power supply suitable for use with electrochemical cell.

The cation-conductive membrane 56 can comprise virtually any known or novel alkali cation-conductive membrane that is capable of selectively transporting specific alkali cations (e.g., $Na^+$, $Li^+$, $K^+$, etc.) from the anolyte compartment 52 to the catholyte compartment 54. Some non-limiting examples of suitable cation-conductive membranes include any known or novel type of NaSICON membranes (including, but not limited to NaSICON-type membranes produced by Ceramatec, Inc.), LiSICON membranes, KSICON membranes, and other related cation-conductive ceramic membranes. In some preferred embodiments, the cation-conductive membrane comprises a membrane, such as a NaSICON-type membrane, which is capable of selectively transporting sodium ions from the anolyte compartment to the catholyte compartment. In some more preferred embodiments, the cation-conductive membrane comprises a NaSICON-type membrane that is operable at lower pHs (e.g., pHs between about 1 and about 6).

The diffusion barrier may perform a variety of functions, such as holding a fluid, which has a higher pH than a fluid in the second space, in contact with the anode side or anolyte side 70 of the cation-conductive membrane 56; limiting the rate at which chemicals from the second space can mix with chemicals from the first space; and allowing current and ions (e.g., $H^+$, $Na^+$, $Li^+$, $K^+$, etc.) to pass therethrough. The diffusion barrier 64 can comprise any suitable characteristic that allows it to be stable in the anolyte solution and to limit the rate at which fluids from the first anolyte space and the second anolyte space mix. In one example, the diffusion barrier comprises a non-permeable material having one or more holes or perforations that pass through the membrane to allow fluid from the first and second spaces to mix. In another example, the barrier comprises a porous material. In still another non-limiting example, the diffusion barrier comprises a micro-porous material. In some instances, the pores in the micro-porous material are sized to allow certain small ions to pass therethrough while preventing passage of larger chemicals. In other example, the diffusion barrier comprises a cation-exchange membrane that transports cations which later pass through the ceramic cation-conductive membrane. In some embodiments, the diffusion barrier is in the form of a porous film, a micro or nano porous separator, or an ion-exchange membrane.

The diffusion barrier can be placed in the anolyte compartment between the membrane and the anode in any suitable position. In some preferred embodiments, however, FIG. 2 shows the diffusion barrier 64 partitions the anolyte compartment 52 so that the first anolyte space 66 has a smaller volume than the second anolyte space 68. Accordingly, in such embodiments, the barrier allows the anolyte side of the membrane to be protected while having little effect on the overall capacity or efficiency of the second space.

While not shown in FIG. 2, the various compartments of the electrochemical cell may also comprise one or more fluid inlets and/or outlets. In some embodiments, the fluid inlets allow specific chemicals and fluids to be added to one or more desired places within the cell. For instance, the fluid inlets may allow a chemical to be added to the anolyte compartment, the catholyte compartment, the first anolyte space, and/or the second anolyte space. In other embodiments, the fluid inlets and outlets may allow fluids to flow through one or more compartments or spaces in the cell. In still other embodiments, these inlets and outlets are also used to interconnect one or more of the cell's compartments. By interconnecting the cell's compartments, outlet streams or effluents from one compartment may be mixed with the contents the other compartment or a portion thereof (e.g., the first anolyte space or the second anolyte space).

With respect to the anolyte solution in the anolyte compartment, the anolyte solution can comprise virtually any solution that allows the anode to evolve protons or initiate a desired electrochemical reaction when current passes between the electrodes. In some preferred embodiments, however, the anolyte comprises an aqueous alkali-salt solution. For instance, where the cation-conductive membrane comprises a NaSICON-type membrane, the anolyte can comprise a sodium salt (NaX), which may include, but is not limited to, sodium lactate ($NaC_3H_5O_3$), sodium nitrate ($NaNO_3$), sodium sulfate ($Na_2SO_4$), and/or sodium chloride (NaCl). Similarly, when the cation-conductive membrane comprises a LiSICON membrane or a KSICON membrane, the anolyte can comprise any suitable lithium salt (LiX) or a potassium salt (KX), including, but not limited to, lithium or potassium salts corresponding to the sodium salts mentioned above.

The catholyte solution can comprise virtually any solution that allows the cathode to evolve hydroxide ions or cause a desired electrochemical reaction when current passes between the electrodes. In some preferred embodiments, however, the catholyte solution comprises water, an aqueous alkali salt solution, a hydroxide solution (e.g., an alkali hydroxide), an organic solution (e.g., an alcohol), and/or combinations thereof. By way of non-limiting example, where the cation-conductive membrane comprises a NaSICON-type membrane, the catholyte solution may comprise an aqueous sodium chloride solution, an aqueous sodium hydroxide solution, etc. Similarly, where the cation-conductive membrane comprises a LiSICON-type membrane, the catholyte solution may comprise an aqueous solution of lithium chloride, lithium hydroxide, etc. Moreover, where the cation-conductive membrane comprises a KSICON membrane, the catholyte solution may comprise an aqueous solution of potassium chloride, potassium hydroxide, etc. Examples of LiSICON-type membranes that conduct Li ions include, $La_xLi_yTiO_{3-z}$ type perovskite, $Li_2O—Al_2O_3—TiO_2—P_2O_5$ glass and $Li_2S—P_2S_5$ Thio-LiSICON. In some embodiments, these membranes are used with aqueous solutions of LiX salt.

The described electrochemical cell can be used in any suitable manner to form a variety of chemical products. To provide a better understanding of the described electrochemical cell, several representative embodiments of the cell and methods for using it are described with reference to FIGS. 3 through 5.

Figure 3:
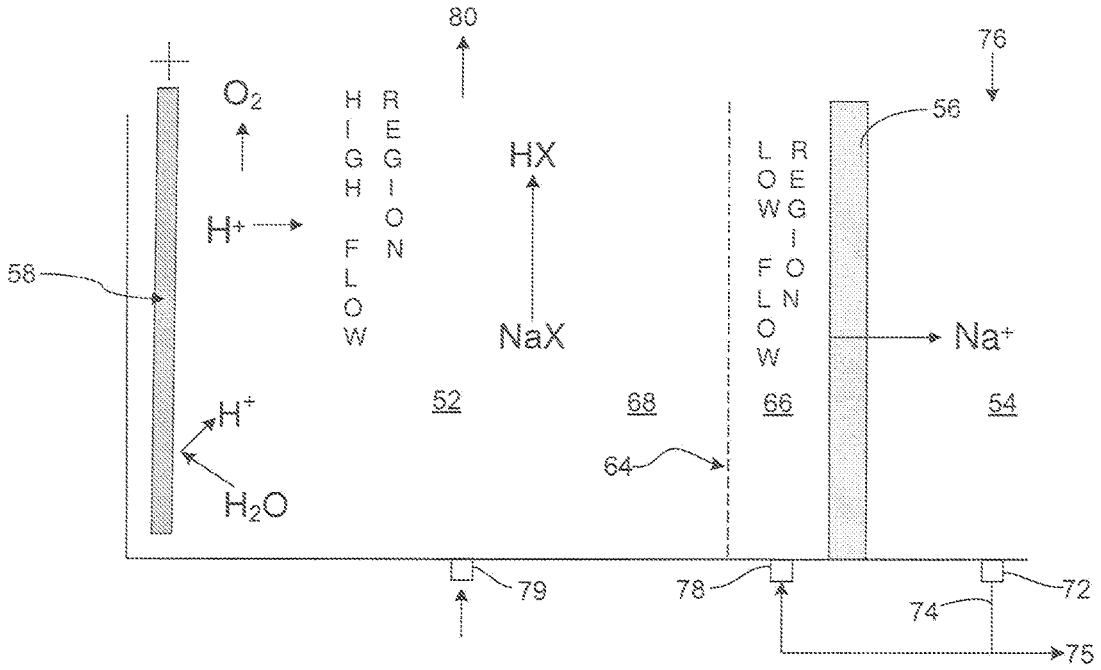
FIG. 3 depicts a schematic diagram of a representative embodiment of the electrochemical cell of FIG. 2, wherein the cell comprises an inlet that allows a catholyte to flow into a space between the diffusion barrier and the cation-conductive membrane.

FIG. 3 illustrates a first non-limiting embodiment in which the catholyte compartment 54 comprises a fluid outlet 72. In this embodiment, a catholyte outlet stream 74 comprising chemicals from the catholyte compartment (e.g., hydroxide ions) can flow from the catholyte compartment 54 into any other suitable space within the cell 50. Indeed, in one example, FIG. 3 shows the catholyte outlet stream 74 is optionally split so that a portion 75 stream is recycled and fed into a first catholyte fluid inlet 76 that opens into the catholyte compartment 54. Accordingly, the cell in this example can recycle the catholyte solution through the catholyte compartment to increase the concentration chemicals that form in that compartment as current passes between the electrodes.

FIG. 3 also shows that the cell 50 comprises a second fluid inlet 78 that opens into the first anolyte space 66 between the cation-conductive membrane 56 and the diffusion barrier 64. Thus, the cell 50 in this example is capable of channeling a portion of the catholyte outlet stream 74 into the first space 66. Accordingly, as the cell functions and the anolyte becomes more acidic and the catholyte becomes more basic, a portion of the catholyte can be channeled into the first space, adjacent to the membrane's anolyte side, to increase the pH of the fluid contacting the membrane or to maintain the pH of the fluid contacting the membrane at a pH level compatible with the effective operation of the cation-conductive membrane 56. In this manner, the cell can produce desired chemical reactions while protecting the membrane 56 from being damaged or becoming inefficient at transporting cations due to the acidic pH of the fluid in the second space. As previously mentioned, the diffusion barrier allows fluids from the first space and the second space to mix (and neutralize each other) at a limited rate. Accordingly, in order to main the proper pH in the first space, in some embodiments, a portion of the catholyte solution from the catholyte outlet stream 74 may continuously flow through the first space 66.

In addition to the aforementioned components, FIG. 3 also shows an embodiment in which the anolyte compartment 52 comprises a fluid inlet 79 and fluid outlet 80 through which anolyte solution may be added and removed as desired. Accordingly, in this first embodiment, the first space and the second space can allow fluids to flow through each space at the same or at different speeds. Indeed, the fluid in the first space and the fluid in the second space may flow at any suitable speed with respect to each other. FIG. 3, however, shows that in some instances the fluid in the first space 66 preferably flows at a slower flow rate (as indicated by the term "LOW FLOW REGION") than does the fluid in the second space 68 (as indicated by the term "HIGH FLOW REGION"). In other words, in some instances, the fluid in the first space has a longer retention time in the cell than does the fluid in the second space. As a result, the acidic fluid in the second space is not given much opportunity to react with and/or to be neutralized by the higher pH fluid in the first space. Moreover, by causing the fluid in the second space to flow at a faster flow rate than the fluid in the first space, the cell allows the fluid in the first space to maintain a pH that is higher than and safer for the membrane than the fluid in the second space.

FIG. 4 illustrates a second non-limiting embodiment of the electrochemical cell 50 in which a first fluid inlet 81 opens into the catholyte compartment 54 and a second fluid inlet 82 opens into the first anolyte space 66. While the first and second fluid inlets 81 and 82 in this embodiment may serve any suitable purpose, in some instances, the first fluid inlet 81 is used to introduce a catholyte solution into the catholyte compartment and the second fluid inlet 82 is used to introduce a pH maintenance chemical into the first space. The pH maintenance chemical may have a basic pH (or a pH higher than the pH of the fluid in the second space) or a chemical which otherwise raises the pH of the fluid in the first space or a non-reactive fluid which has a suitable pH. In one embodiment, the pH maintenance chemical includes the catholyte. The second fluid inlet 82 may also be used to introduce any suitable chemical that allows the cell to function as intended. Some non-limiting examples of suitable pH maintenance chemicals that can be channeled into the first space include ammonium hydroxide and/or ammonia gas. By introducing a basic chemical, such as ammonium hydroxide or ammonia gas, into the first space, the cell is able to regulate the pH of the fluid that contacts the anolyte side of the cation-conducting membrane.

As in the electrochemical cell discussed in the second embodiment above, FIG. 4 shows that the cell 50 in this second embodiment comprises a fluid inlet 79 that opens into the second space 68. As a result, both the first space and the second space in this embodiment can allow fluids to flow through each at the same or at different flow rates. Indeed, the fluid in the first space and the fluid in the second space may flow at any suitable flow rate with respect to each other. In some instances, however, FIG. 4 indicates that the fluid in the first space 66 preferably flows at a slower flow rate (as indicated by the term "LOW FLOW REGION") than does the fluid in the second space 68 (as indicated by the term "HIGH FLOW REGION"). As a result, the acidic fluid in the second space is given little opportunity to react with and/or to be neutralized by the higher pH fluid in the first space. Moreover, by causing the fluid in the second space to flow at a faster flow rate than the fluid in the first space, the cell allows the fluid in the first space to maintain a pH that is higher than the fluid in the second space.

FIG. 5 illustrates a third non-limiting embodiment in which the electrochemical cell 50 comprises a catholyte outlet 84 that opens from the catholyte compartment 54 and a first 86 and second 88 fluid inlet that open into the first 66 and second 68 spaces, respectively. While these inlets and outlets may function in any suitable manner, FIG. 5 shows an embodiment in which a catholyte outlet stream 90 is split into a first inlet stream 92 and a second inlet stream 94, which are fed into the first 66 and second 68 anolyte spaces, respectively. In this manner, the cell allows bases in the catholyte compartment to raise and/or maintain the pH of the fluid in contact with the membrane's anolyte side and further allows bases or other chemicals in the catholyte compartment to be directly introduced into the second space where they can either participate in further anodic reaction to form specific products or react with the chemicals found in the second space to form other specific products.

Where the outlet stream 90 from the catholyte compartment 54 is split into the first and the second inlet streams, which are fed into the first and second spaces, each stream can comprise any suitable percent of the total volume of the catholyte outlet stream. In some preferred embodiments, however, the first inlet stream 92 comprises a smaller percent of the total volume of the catholyte outlet stream 90 than does the second inlet stream 94. Indeed, in some embodiments, the catholyte outlet stream is split so the first inlet stream 92 comprises between about 1% and about 49% of the total volume of the outlet stream 90. In other embodiments, the first inlet stream 92 comprises between about 5% and about 40% of the catholyte outlet stream's total volume. In still other embodiments, the first inlet stream 92 comprises between about 10 and about 30% of the catholyte outlet stream's total volume.

In this third embodiment, the fluid in the first space 66 and the fluid in the second space 68 may flow at any suitable flow rate with respect to each other. In some instances, however, FIG. 5 indicates that the fluid in the first space 66 preferably flows at a faster flow rate (as indicated by the term "HFR") than does the fluid in the second space 68 (as indicated by the term "LFR"). In this manner, the fluid in the first space 66 is allowed to quickly flow by the membrane's anolyte side and protect the membrane 56 from the acidic pH of the fluid in the second anolyte space 68. Additionally, because the fluid in the second space has a comparatively slow flow rate, chemicals from the catholyte outlet stream are retained in contact with the anode in the second space for a period of time that allows the anolyte reactions to occur.

After fluids have passed through the first 66 and second 68 spaces, FIG. 5 shows that, in some embodiments, a first anolyte outlet stream 96 from the first space 66 is mixed with a second anolyte outlet stream 98 from the second space 68. In this manner, chemicals from the first space 66 and the second space 68 can react to form additional chemical products and/or higher concentrations of chemical products than possible without the diffusion barrier 64, as will be described below.

The described electrochemical cell may function to produce a wide range of chemical products, including, but not limited to, acids that correspond to alkali salts or alkali bases, substantially pure alkali metals, chlorine-based oxidant products, oxygen, chlorine, hydrogen, biofuels, and/or a variety of other chemical products. In one non-limiting example, the cells in the first and second embodiments (described above) are used to obtain one or more acids corresponding to alkali salts and/or to obtain one or more alkali metals. For simplicity, this example discusses using a sodium salt to produce an acid and/or to obtain an alkali metal. Nevertheless, the skilled artisan will recognize that this example can be modified to produce acids, alkali metals, and electrochemical products from another alkali salt, such as a lithium salt or a potassium salt.

In this first example, FIGS. 3 and 4 show that where the anolyte solution comprises a sodium salt (NaX) (including, but not limited to, sodium lactate ($NaC_3H_5O_3$), sodium nitrate ($NaNO_3$), sodium sulfate ($Na_2SO_4$), and/or sodium chloride (NaCl)) the salt can be split in the second space 68 into its anion ($Na^+$) and its cation ($X^-$) (e.g., $C_3H_5O_3^-$, $NO_3^-$, $Cl^-$, etc.). FIGS. 3 and 4 illustrate that the cation from the salt may react with protons evolved from the anode to form an acid (HX) (e.g., lactic acid ($C_3H_6O_3$), nitric acid ($HNO_3$), hydrochloric acid (HCl), etc.) that corresponds to the original sodium salt (NaX). FIGS. 3 and 4 further illustrate that the sodium cation ($Na^+$) is selectively transported through the cation-conductive membrane 56 (e.g., a NaSICON membrane) into the catholyte compartment 54, where it can be collected (e.g., as sodium metal, as sodium hydroxide, or in some other suitable form).

In another non-limiting example, the cell in the third embodiment (described above) is used to produce a chlorine-based oxidant, such as sodium hypochlorite. As in the last example, for simplicity, this example focuses on forming the chlorine-based oxidant with a sodium salt solution.

Importantly, however, the skilled artisan will recognize that the cell in third embodiment can be used to produce other chlorine-based oxidants, such as lithium hypochlorite and potassium hypochlorite, through the use of another alkali-salt solution, such as a lithium salt solution and potassium salt solution, respectively.

In this example, FIG. 5 shows an embodiment in which an aqueous sodium chloride feed stream 100 is added to the catholyte compartment 54 and channeled through the catholyte outlet stream 90 into the first 66 and second 68 anolyte spaces. In this embodiment, the aqueous sodium chloride solution comprise virtually any sodium chloride solution, including, but not limited to, brine, seawater, tap water comprising sodium chloride, etc.

Where the feed stream added to the catholyte compartment comprises an aqueous solution of sodium chloride (or another alkali-chloride salt), the stream may comprise any suitable concentration of sodium chloride. In some embodiments, the concentration of sodium chloride in the feed stream is between about 0.2 wt % and about 26 wt %. In other embodiments, the concentration of sodium chloride in the feed stream is between about 2 wt % and about 20 wt %. In still other embodiments, the sodium chloride concentration in the feed stream is between about 3 wt % and about 13 wt % (e.g., about 10 wt %±2 wt %). For example, the feed stream added to the catholyte compartment comprises between about 2.5 wt % and about 4.5 wt % sodium chloride. In another example, the feed stream comprises between about 8 wt % and about 12 wt % sodium chloride.

TABLE 1

Chemical Equations for the Reactions in the Cell Shown in FIG. 5.

| Reaction Name/Example of Suitable Location | Reaction Description |
|---|---|
| R1/Anolyte and Catholyte Compartment | $Na^+ + Cl^-$ |
| R2/Cathode | $2H_2O + 2e^- + 2Na^+ \rightarrow 2NaOH + H_2$ |
| R3/Anode | $2Cl^- \rightarrow Cl_2 + 2e^-$ |
| R4/Anolyte Compartment | $Cl_2 + H_2O \rightarrow HOCl + HCl$ |
| R5/Anolyte Compartment and Outside Cell | $HOCl + HCl + 2NaOH \rightarrow NaOCl + NaCl + H_2O$ |
| R6/Anolyte Compartment and Outside Cell | $Cl_2 + 2NaOH \rightarrow NaOCl + NaCl + H_2O$ |

FIG. 5 and Table 1 (shown above) show, that in the third embodiment, as current passes between the anode 58 and the cathode 60 and as the catholyte outlet stream 90 is channeled through the first 66 and second 68 spaces, a variety of chemical reactions can occur in the cell 50. Specifically, FIG. 5 and Table 1 show that, at reaction R1, sodium chloride is split into its respective cation ($Na^+$) and anion ($Cl^-$) in both the anolyte compartment 52 and the catholyte 54 compartment. Moreover, FIG. 5 shows that sodium cations in the anolyte compartment 52 are selectively transported through the membrane 56 (e.g., a NaSICON membrane) to the catholyte compartment 54.

In the catholyte compartment, FIG. 5 and Table 1 show that, at reaction R2, water reacts with the sodium cation at the anode 60 to form sodium hydroxide and hydrogen gas, which can be vented or collected. Similarly, FIG. 5 and Table 1 show that, at reaction R3, chlorine anions react at the anode to form chlorine gas. Moreover, at reaction R4, FIG. 5 and Table 1 show that chlorine gas in the anolyte compartment reacts with water to from hypochlorous acid (HOCl) and hydrochloric acid (HCl).

After the catholyte outlet stream 90 comprising sodium hydroxide is introduced into the first 66 and second 68 anolyte spaces, FIG. 5 and Table 1 show at reaction R5, that hypochlorous acid and hydrochloric acid react with sodium hydroxide to form sodium hypochlorite, sodium chloride, and water. While reaction R5 may occur in any suitable location, FIG. 5 shows an embodiment in which reaction R5 occurs both in the anolyte compartment 52 and in a separate vessel 102 in which the first 96 and second 98 anolyte outlet streams are mixed. Additionally, FIG. 5 and Table 1 show that, at reaction R6, chlorine gas reacts with sodium hydroxide to form sodium hypochlorite, sodium chloride, and water. While reaction R6 may also occur in any suitable location, FIG. 5 shows that, like reaction R5, reaction R6 typically occurs in the anolyte compartment 52 and/or the separate vessel 102.

In the described embodiments, the pH of first space may be maintained at any level that protects the membrane from being damaged or being made inefficient by the acidic fluid in the second space. In some embodiments, for instance, the pH of the first space is maintained above a pH of about 4.5. In other embodiments, the pH of the first space is maintained above a pH of about 5. In still other embodiments, the pH of the first anolyte space is maintained above about 6.5. In still other embodiments, the pH of the first anolyte space is maintained at a pH above about 7. In one embodiment, the pH in the first space can be as high as 11.

The present invention is also applicable to multi-compartment electrolytic or electrodialysis cell. One non-limiting example of a multi-compartment electrolytic cell is a three compartment cell. The cell comprises an anolyte compartment, a center compartment and a catholyte compartment. The anolyte compartment and center compartments are separated by an anionic or cationic membrane and the catholyte compartment and center compartments are separated by a NaSICON membrane.

During operation, the anolyte compartment comprising an aqueous solution and current is passed between an anode and a cathode. As the cell operates, water ($H_2O$) is split at the anode to form oxygen gas ($O_2$) and protons ($H^+$) through the reaction $2H_2O \rightarrow O_2 + 4H^+ + 4e^-$. The protons formed in the anolyte compartment may back diffuse to the center compartment lowering the pH within the center compartment. As in the case of two-compartment cells this lowering of pH will result in NaSICON-type membranes becoming less efficient or unable to transport sodium cations. In one embodiment, the cation membrane protection schemes disclosed above are utilized to prolong or increase membrane efficiencies.

The described systems and methods can be varied in any suitable manner. For instance, in addition to the described components, the electrochemical cell may comprise any other suitable component, such as a coolant system, a conventional pH controlling system to control the addition of the base to the first space, a secondary cathode to generate the base in situ, etc. Indeed, because the described systems and methods may function best between about 15° and about 30° Celsius, in some preferred embodiments, the described cell is used with a coolant system. In another example, additional chemical ingredients are added to the different areas of the cell for any suitable purpose (e.g., to modify fluid pH, to combat scaling on the electrodes and/or membrane, prevent corrosion of electrodes and/or membrane, etc.). In still another example, effluents from one compartment or space are fed into a desired compartment or space at any suitable time (e.g., any suitable time after the introduction of a feed stream into the cell) and in any suitable amount. In yet another example, a secondary cathode can be placed in the first space to evolve hydroxide ions and thereby maintain the pH of the membrane's anolyte side at a suitable level. Thus in one embodiment, the operation of the electrochemical cell results in generation of acid in the anolyte and base in the catholyte.

The described systems and methods may also have several beneficial characteristics. In one example, the described systems and methods protect the cation-conductive membrane from the low pH of the second anolyte compartment without greatly increasing the pH of the fluid in the second anolyte space. Accordingly, the described systems and methods allow the cell to efficiently produce desired chemical products without damaging the membrane to same extend as would occur if the diffusion barrier were not present. In one example, the described systems and methods can be used to produce acids from impure alkali metal salts, e.g. sulfuric acid from sodium sulfate waste. In another example, the described systems and methods can use inexpensive ingredients, such as seawater, brine, tap water with sodium chloride, etc. to produce sodium hypochlorite. For instance, where the cell is used on a ship at sea, the cell can use seawater to produce disinfectants, such as sodium hypochlorite and hypochlorous acid. In still another example, the described methods may be used to produce chlorine-based oxidants, such as sodium hypochlorite, on demand and continuously, as desired. In still another example, some embodiments of the electrochemical cell can be portable and, thereby, allow sodium hypochlorite or another chemical product to be produced at the site where it will be used. In a final example, the described systems and methods are more efficient at producing sodium hypochlorite than are certain conventional methods that produce the chlorine-based oxidant with an electrolytic cell.

The following examples are given to illustrate various embodiments within the scope of the present invention. These are given by way of example only, and it is understood that the following examples are not comprehensive or exhaustive of the many types of embodiments of the present invention that can be prepared in accordance with the present invention. While specific embodiments and examples of the present invention have been illustrated and described, numerous modifications come to mind without significantly departing from the spirit of the invention, and the scope of protection is only limited by the scope of the accompanying claims.

The invention claimed is:

1. An electrochemical cell, comprising:

an anolyte compartment comprising an acidic anolyte solution and an anode in contact with the acidic anolyte solution;

a catholyte compartment comprising a basic catholyte solution and a cathode in contact with the catholyte solution;

an alkali cation-conductive ceramic membrane positioned between the anolyte and catholyte compartments; and a cation permeable, porous diffusion barrier disposed in the anolyte compartment, the diffusion barrier separating the anolyte compartment into a first anolyte space, located between the cation-conductive ceramic membrane and the diffusion barrier, and a second anolyte space that holds the anode, the first anolyte space and the second anolyte space containing the acidic anolyte solution, the diffusion barrier slowing the rate at which chemicals in the acidic anolyte solution pass between the first and second anolyte spaces and mix with each other, the first anolyte space having a first fluid inlet and a first fluid outlet other than the diffusion barrier, and the second anolyte space having a second fluid inlet and a second fluid outlet other than the diffusion barrier; and a first flow of the anolyte solution that passes through the first anolyte space and out the first fluid outlet and a second flow of the anolyte solution that passes through the second anolyte space and out the second fluid outlet.

2. The electrochemical cell of claim 1, wherein the first flow of the anolyte solution comprises a chemical selected from ammonium hydroxide and ammonia gas, and the catholyte compartment having a catholyte fluid outlet fluidly connected to the first fluid inlet, the catholyte fluid outlet further fluidly connected to the second fluid inlet.

3. The electrochemical cell of claim 1, wherein the first flow of the anolyte solution comprises a portion of the basic catholyte solution from the catholyte compartment that enters the first anolyte space through the first fluid inlet as a basic solution.

4. The electrochemical cell of claim 1, wherein the first flow through the first anolyte space has a flow rate different from a flow rate of the second flow through the second anolyte space.

5. The electrochemical cell of claim 3, wherein the second flow of the anolyte solution comprises a portion of the basic catholyte solution from the catholyte compartment that enters the second anolyte space through the second fluid inlet as a basic solution.

6. The electrochemical cell of claim 1, wherein the cation-conductive ceramic membrane comprises a NaSICON membrane selective to sodium ions.

7. The electrochemical cell of claim 1, wherein the diffusion barrier comprises a porous film, or a micro or nano porous separator.

8. The electrochemical cell of claim 1, wherein the acidic anolyte solution comprises an alkali salt selected from sodium lactate, sodium sulfate, sodium nitrate, sodium chloride, and combinations thereof.

9. The electrochemical cell of claim 1, wherein the first flow of the anolyte solution within the first anolyte space has a pH higher than the second flow the anolyte solution within the second anolyte space.

10. The electrochemical cell of claim 9, wherein the first flow of the anolyte solution within first anolyte space is maintained at a pH above about 5.

11. The electrochemical cell of claim 9, wherein the first flow of the anolyte solution within first anolyte space is maintained at a pH above about 6.5.

12. An electrochemical cell system, comprising:

an anolyte compartment comprising an anolyte solution and an anode in contact with the anolyte solution, the anode together with the anolyte solution being configured to produce an acid;

a catholyte compartment comprising a catholyte solution and a cathode in contact with the catholyte solution, the cathode together with the catholyte solution being configured to produce a base;

an alkali cation-conductive ceramic membrane positioned between the anolyte and catholyte compartments, the cation-conductive ceramic membrane exhibiting the property of becoming less efficient in transport of alkali cations at a pH less than about 5 compared to transport at a pH greater than about 5;

a cation permeable, porous diffusion barrier disposed in the anolyte compartment, the diffusion barrier separating the anolyte compartment into a first anolyte space, located between the cation-conductive ceramic membrane and the diffusion barrier, and a second anolyte space that holds the anode, the diffusion barrier slowing the rate at which chemicals in the anolyte solution pass between the first and second anolyte spaces and mix with each other, the first and second anolyte spaces containing the anolyte solution and a first portion of the anolyte solution within the first anolyte space having a pH higher than an acidic, second portion of the anolyte solution within the second anolyte space;

the first anolyte space having a first fluid inlet and a first fluid outlet other than the diffusion barrier, the second anolyte space having a second fluid inlet and a second fluid outlet other than the diffusion barrier, the first portion of the anolyte solution flowing through the first anolyte space and out the first fluid outlet, and the second portion of the anolyte solution flowing through the second anolyte space and out the second fluid outlet;

the catholyte compartment having a third fluid outlet fluidly connected to the first fluid inlet, the third fluid outlet further fluidly connected to the second fluid inlet; and a pH control system configured to control addition of the base to the first anolyte space through the first fluid inlet, the pH control system configuration including settings that maintain the first portion of the anolyte solution at the pH higher than the acidic, second portion of the anolyte solution and that maintain a first flow rate through the first anolyte space different from a second flow rate through the second anolyte space.

13. The electrochemical cell of claim 12, wherein the second flow rate is higher than the first flow rate.

14. The electrochemical cell of claim 12, wherein the first flow rate is higher than the second flow rate.

15. An electrochemical cell system, comprising:

an anolyte compartment holding an anolyte solution, the anolyte compartment including an anode in contact with the anolyte solution and the anolyte solution containing an aqueous alkali-salt solution;

a catholyte compartment holding a catholyte solution, the catholyte compartment including a cathode in contact with the catholyte solution;

an alkali cation-conductive membrane positioned between the anolyte compartment and the catholyte compartment, the cation-conductive membrane exhibiting the property of becoming less efficient in transport of alkali cations at a pH less than about 5 compared to transport at a pH greater than about 5;

a diffusion barrier disposed in the anolyte compartment, the diffusion barrier separating the anolyte compartment into a first anolyte space that is disposed between the cation-conductive membrane and the diffusion barrier and a second anolyte space that holds the anode, the first anolyte space having a first fluid inlet and the second anolyte space having a second fluid inlet the anolyte compartment consisting of a single fluid outlet;

further comprising a first flow of the anolyte solution that passes through the first anolyte space and out the first fluid outlet at a first flow rate, a second flow of the anolyte solution that passes through the second anolyte space and out the second fluid outlet at a different, second flow rate, a first portion of the catholyte solution that flows through the first inlet into the first anolyte space in a first quantity, and a second portion of the catholyte solution that flows through the second inlet into the second anolyte space in a second quantity greater than the first quantity;

an electrical current path between the anode and the cathode, the passing of current through the electrical current path being configured to generate an acid in the anolyte and a base in the catholyte; and a pH maintenance chemical and a pH control system configured to control introduction of the pH maintenance chemical into the first anolyte space through the first fluid inlet, the pH control system configuration including settings that maintain the first anolyte space at a pH greater than about 5.

16. The system of claim 15, wherein the pH maintenance chemical comprises the catholyte solution.

17. The system of claim 16, wherein the catholyte solution comprises ammonium hydroxide or ammonia gas.

* * * * *